United States Patent [19]

Ronden

[11] Patent Number: 4,466,885

[45] Date of Patent: Aug. 21, 1984

[54] METHOD FOR REMOVING SOLIDS AND WATER FROM PETROLEUM CRUDES

[75] Inventor: Clifford P. Ronden, Edmonton, Canada

[73] Assignee: Husky Oil Operations Ltd., Calgary, Canada

[21] Appl. No.: 397,934

[22] Filed: Jul. 13, 1982

[51] Int. Cl.[3] ..... C10G 33/04

[52] U.S. Cl. ..... 208/188; 210/708; 210/724; 210/727

[58] Field of Search ..... 208/188, 229, 230, 226; 210/708, 724, 727, 728

[56] References Cited

U.S. PATENT DOCUMENTS

| | | | |
|---|---|---|---|
| 2,446,040 | 7/1948 | Blair, Jr. | 208/188 |
| 3,547,803 | 12/1970 | Barkman et al. | 208/188 |
| 4,040,955 | 8/1977 | Davidson | 210/724 |
| 4,143,085 | 3/1979 | Funada et al. | 208/188 |
| 4,272,360 | 6/1981 | Bialek | 208/188 |
| 4,392,944 | 7/1983 | Kessick | 208/188 |

*Primary Examiner*—Delbert E. Gantz
*Assistant Examiner*—Cynthia A. Prezlock
*Attorney, Agent, or Firm*—Roylance, Abrams, Berdo & Goodman

[57] ABSTRACT

Particulate solids and water are removed from petroleum crude to bring the BS&W content of the crude within pipeline specifications by treating a blended and dewatered crude to destabilize the water-in-oil emulsion of the crude and providing in uniform distribution through the treated crude both produced water and an acid-reacting coagulating agent while maintaining the crude at a pH of at least 8, then maintaining the resulting treated crude at 52°-88° C. for at least a few minutes, separating the treated crude into at least an oil phase and a water phase, and recovering the oil phase as a clean blended crude oil having a BS&W content within pipeline specifications and in a yield significantly greater than that which can be recovered without use of produced water and coagulating agent.

15 Claims, 2 Drawing Figures

METHOD FOR REMOVING SOLIDS AND WATER FROM PETROLEUM CRUDES

This invention relates to treatment of petroleum crudes, especially the difficultly treatable heavy oil crudes produced by enhanced recovery procedures, to remove particulate solids and water from the crude and bring the crude within pipeline specifications.

RELATED APPLICATIONS

Subject matter disclosed in this application is also disclosed and claimed in copending application Ser. No. 397,935, filed concurrently herewith by Clifford P. Ronden and Donald C. Roylance, and now abandoned in favor of continuing application Ser. No. 522,651, filed Aug. 12, 1983, and Ser. No. 397,696, filed concurrently herewith by Clifford P. Ronden, now abandoned in favor of continuing application Ser. No. 552,865, filed Nov. 17, 1983.

BACKGROUND OF THE INVENTION

As produced at the wellhead, crude petroleum oils contain substantial quantities of inorganic particulates and water and it has long been standard practice to require that the combined solids and water (BS&W) content be reduced to a value not exceeding a stated small percentage before the crude is introduced to a pipeline or supplied to a refinery. Such reduction of the BS&W content is necessary both to minimize damage to pipeline and refinery equipment from, e.g., corrosion and abrasive wear, and to minimize economic loss arising from transporting and processing the non-petroleum constituents making up the BS&W content. Though specifications vary among localities and refineries, a typical specification requires that the BS&W content of the crude not exceed 0.5% by volume.

The BS&W content of many crudes can be brought within pipeline specifications by adding chemical treating agents (commonly referred to in the field as demulsifiers) intended to break the very stable water-in-oil emulsions (including those which are complex) which characterize such crudes, and then recovering clean oil by gravitational separation, typically carried out in a conventional heater-treater. Other crudes, particularly the heavy oil crudes as a class and within that class especially the crudes obtained by enhanced production procedures, especially by thermal recovery procedures such as fireflooding and steamflooding, do not respond adequately to conventional treatment, and no fully satisfactory way has heretofore been devised for bringing the BS&W content of such crudes within pipeline specifications. The more difficultly treatable crudes are high viscous, so that in all events the raw crude from the wellhead must be diluted with a compatible hydrocarbon diluent, typically a wide gasoline fraction (condensate), to achieve adequate fluidity for handling and treatment. However, even when the more difficultly treatable crudes are thus diluted and then treated with one or more conventional demulsifiers, attempts to recover clean oil with a BS&W content within pipeline specifications by simple gravitational separation procedures do not usually succeed. Thus, for example, such attempts with heavy oil crudes obtained by fireflooding in the Husky Aberfeldy field have heretofore not succeeded in satisfactory removal of water and solids even though substantially all demulsifiers available from the oilfield service trade were tested.

Any successful treatment for separating particulate solids and water from the difficultly treatable heavy oil crudes requires that the water-in-oil emulsion characterizing such crudes first be at least destabilized, and that task has itself been difficult to accomplish. As described in detail in aforementioned application Ser. No. 397,935, it has been discovered that the emulsions of such crudes can be destabilized by uniformly distributing through the crude, while the crude is at a pH of at least 8 and advantageously at least 10, an agent capable of acting on the inorganic sulfur content of the crude, ammonium bisulfite being particularly useful as such an agent, the crude thus treated then being heated at 52°-88° C. (125°-190° F.) for at least a few minutes. Using that method, even the more difficult crudes, such as the fireflood crudes from the Husky Aberfeldy field, can be brought to a BS&W content below 0.5% by volume. During development of that method, it was discovered that breaking of the emulsions in the difficultly treatable crudes frequently produces a significant flocculated phase, occurring between the clean oil phase and the water phase upon phase separation, and that occurrence of the intermediate flocculated phase not only increases the time required for phase separation but also reduces the clean oil yield. Similar problems are encountered with the less difficultly treatable crudes when the emulsion of the crude is broken by other methods. There has thus been a need to provide a method for achieving a quicker and more effective phase separation during removal of particulate solids and water from petroleum crudes.

OBJECTS OF THE INVENTION

A general object of the invention is accordingly to devise a method for separating particulate solids and water from petroleum crudes in which, once the water-in-oil emulsion of the crude has been destabilized so that phase separation can occur, a maximum clean oil phase can be relatively quickly recovered.

Another object is to provide a method for minimizing the adverse effects of the intermediate flocculated phase when the water-in-oil emulsion of a petroleum crude has been broken and phase separation is carried out.

A further object is to decrease the time required for phase separation when petroleum crudes are treated by methods which break the water-in-oil emulsion of the crude.

Yet another object is to achieve expeditious and high-yield recovery of clean oil having a BS&W content within pipeline specifications from petroleum crudes generally and particularly from heavy oil crudes obtained by thermal methods and other enhanced recovery procedures.

SUMMARY OF THE INVENTION

Broadly considered, the invention is applicable to any petroleum crude having a BS&W content above pipeline specifications and which contains both free water and water present as the disperse phase of a water-in-oil emulsion, whether the emulsion be a simple emulsion or a complex emulsion in which oil is dispersed through the water globules of the disperse phase. Methods according to the invention can commence with a petroleum crude which has been blended with a compatible diluent to provide a blended crude having an API gravity of at least 17 and from which a substantial portion of free water has been separated so as to separately provide both a blended crude of reduced water content and produced water having a native content of dissolved inorganic compounds. The blended crude of reduced water content is treated to destabilize the water-in-oil emulsion of the crude, and there is provided in the blended and dewatered crude a uniformly distributed small amount of an acid-reacting coagulating agent and an amount of the produced water equal to at least 5% of the volume of the dewatered blended crude while the pH of the blend is maintained at at least 8. The resulting treated crude is maintained at 52°-88° C. (125°-190° F.) for from a few minutes to a few hours or longer while agitating the crude, and the resulting liquid is then separated into at least an oil phase and a water phase, and the oil phase is recovered as a clean blended crude oil having a BS&W content within pipeline specifications. When both produced water and a coagulating agent are employed in the manner recited above, it appears that solids precipitated from the produced water seed the agglomeration of the liquids and solids which otherwise tend to form the intermediate flocculate phase, promoting a prompt and clean phase separation.

Effectiveness of the produced water and coagulating agent depends not just upon successful destabilization of the water-in-oil emulsion of the crude but also upon having the pH of the total crude blend at at least 8, advantageously at least 10. Even though an alkalyzing agent may have been introduced to aid destabilization of the emulsion, the pH of the total liquid decreases with time, and it is advantageous to introduce an additional quantity of alkaline material at or near the time of introduction of the produced water and coagulating agent.

Surprisingly, the method appears to enhance the effectiveness of conventional demulsifiers, and presence of a small amount of a conventional demulsifier in uniform distribution throughout the blended crude results in a cleaner phase separation and a better yield of oil with a lower BS&W content than when the demulsifier is not employed, even when the crude being treated is one that cannot be successfully treated with that demulsifier using conventional practices. While the reason for this advantageous result is not fully understood, it is noted that, when it occurs, the intermediate flocculated phase includes not only oil and water but also particulate solids, some of the solids being in the size range of from less than 1 micron to several microns, and that, while persistent, the intermediate flocculated phase appears to be relatively unstable, having perhaps as much affinity for the oil phase as for the water phase. It is believed that some of the crudes contain very finely particulate inorganic materials associated with the oil of the crude in such fashion that the gelatinous precipitate resulting from a coagulating agent cannot by itself affect such particles and that a demulsifier alone cannot free the particles from the oil. However, when both the coagulating agent and the demulsifier are used, it is likely that the surfactant action upon the finely particulate solids is adequate to make the particles more available to the gelatinous precipitate from the coagulating agent, so that the gelatinous precipitate is better able to agglomerate the fine particles into relatively larger agglomerates which, upon phase separation, separate into the water phase rather than promoting the troublesome intermediate flocculated phase.

IDENTIFICATION OF THE DRAWINGS

In order that the manner in which the foregoing and other objects are attained according to the invention can be understood in detail, particularly advantageous embodiments thereof will be described with reference to the accompanying drawings, which form part of the original disclosure of this application, and wherein.

DETAILED DESCRIPTION OF THE METHOD

Characterization of Crudes Treatable According to the Invention

While methods according to the invention are applicable to all petroleum crudes having a BS&W content substantially in excess of pipeline specifications and containing water as the disperse phase of a water-in-oil emulsion, the invention offers particular advantage in treatment of heavy oil crudes, especially those obtained by enhanced recovery procedures, and particularly those obtained by fireflooding and steamflooding. Typical of the heavy oil crudes are those produced from the Cretaceous reservoirs in the Western Canada sedimentary basin, including the Cold Lake, Lloydminster and Medicine River fields. The Lloydminster crudes, including Husky Aberfeldy, Husky G.N.O.L. Golden Lake, Murphy Silverdale, Mobile-GC Silverdale, Mobile-GC Kitscoty and Brascan Lindbergh, are specific examples of the heavy oil crudes for the treatment of which the invention is especially advantageous. Such crudes typically have an API gravity of 12-16, sometimes 10-18, a pH of 5.5-6.8, sometimes 4-8, and BS&W contents ranging to as much as 70% by volume. Though such crudes contain a substantial proportion of free water, i.e., water which separates reasonably promptly by simple gravitational settling, a substantial part of the water content is present as the disperse phase of a water-in-oil emulsion, with the water globules of the disperse phase being as small as 0.5-2.5 microns and in at least some cases containing some dispersed oil, so that the emulsion can be considered to be complex.

General Procedure

Starting material for the method can be raw crude from the wellhead, a blend of raw crudes from a plurality of wells, a crude or crudes previously blended with a compatible hydrocarbon diluent and dewatered by gravitational settling, with or without addition of a demulsifier, slop oil, or a blend of such petroleum materials, the starting material in all events having a BS&W content in excess of pipeline specifications and including water present as the disperse phase of a water-in-oil emulsion. When the starting material has already been dewatered, the recovered free water, or other produced water, should be available for use in the process.

Figure 1:
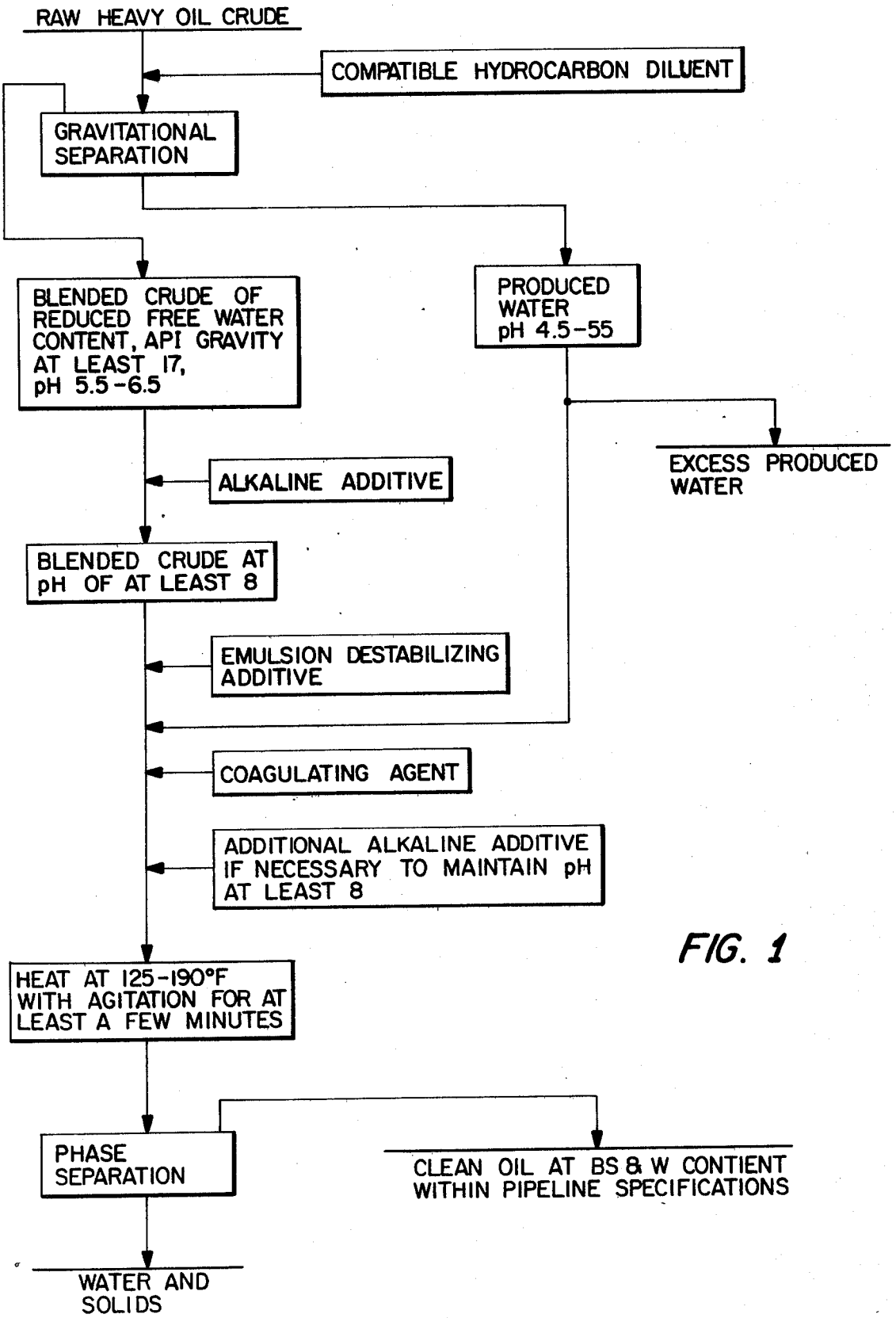
FIG. 1 is a generalized flow sheet illustrating the method.

The generalized flow sheet of FIG. 1 illustrates the method as employed for separating solids and water from a raw heavy oil crude produced by an enhanced recovery procedure, the raw crude of course containing free water in addition to emulsified water. Since such a crude is too viscous for practical handling, the first step of the method in this embodiment is to blend the raw crude with a compatible hydrocarbon diluent, advantageously a wide gasoline fraction (condensate), in a proportion adequate to raise the API gravity to at least 17, advantageously to at least 20, the amount of condensate required usually being 20-50% of the volume of the resulting blend, depending upon the particular crude.

The resulting product is a blended crude usually having a BS&W content of 2–10% by volume and a pH of 5.5–6.5. The next step is to separate at least a substantial proportion of the free water from the crude, advantageously by conventional gravitational separation, in order to obtain produced water, to be later used, and a blended crude of reduced water content for further treatment.

It is next necessary to at least destabilize the water-in-oil emulsion of the blended crude. Though this can be accomplished in any suitable fashion, depending upon the particular nature of the crude being treated, best results with the heavy oil crudes are obtained by distributing through the blended crude an amount of at least one alkalyzing agent adequate to raise the pH of the blended crude to at least 8 and advantageously to at least 10 and uniformly distributing through the crude an inorganic additive capable of acting directly on the inorganic sulfur of the crude, such additives typically being the alkali metal, alkaline earth metal and ammonium monosulfides and hydrosulfides and agents, typically ammonium bisulfite and the hydrosulfites of alkali metals and alkaline earth metals, capable of reacting in the crude under the conditions of treatment to yield in situ monosulfides and/or hydrosulfides. For reasons of economy, ease of handling and effectiveness, it is advantageous to employ an aqueous solution of ammonium bisulfite as the inorganic additive for destabilizing the emulsion.

At this stage, a portion of the produced water obtained by removal of free water from the blended crude is introduced, as well as a small proportion of an acid-reacting coagulated agent, and if the pH of the blended crude has decreased, an additional quantity of alkalyzing agent adequate to reestablish a pH of at least 8. Advantageously, the coagulating agent can be dissolved in part or all of the produced water which is introduced into the blended crude. While any acid-reacting coagulating agent compatible with the blended crude can be employed, filter alum [$Al_2(SO_4)_3 18H_2O$] is particularly useful. Potash alum [$Al_2(SO_4)_3K_2SO_4 24H_2O$], ammonia alum [$Al_2(SO_4)_3(NH_4)_2SO 24H_2O$], ferric sulfate and ferrous sulfate are also useful.

Whether separated from the crude to be treated or obtained from another source, the produced water employed must have a pH below neutral and a substantial mineral content, including both dissolved inorganic compounds and suspended solids. The usual produced waters have a pH of 4.5–5.5, and the pH range is adequate to assure that, when the coagulating agent is dissolved in the produced water before being incorporated in the blended crude, the coagulating agent will not react prematurely. For the coagulating agent to be effective, once that agent and the produced water have been distributed through the crude and exposed to alkaline conditions, the produced water should contain enough of at least one inorganic compound for there to be a significant reaction between that compound and the coagulating agent to produce the corresponding gelatinous hydroxide responsible for the coagulating effect, though it is to be noted that the coagulating agent also reacts with the alkalyzing agent which has been introduced separately into the crude. The following analysis is for produced water obtained by dewatering Husky Aberfeldy crudes, and is typical for produced waters useful according to the invention:

| Constituent | Content (mg/l) |
|---|---|
| Total filterable residue | 55080 |
| Fixed filterable residue | 43500 |
| Sodium and potassium (Calculated as Na) | 15237 |
| Calcium | 1403 |
| Magnesium | 730 |
| Total hardness (as $CaCO_3$) | 6507 |
| Carbonate ($CO_3$) | nil |
| Bicarbonate ($HCO_3$) | 220 |
| Total alkalinity[3] (as $CaCO_3$) | 181 |
| Sulfate ($SO_4$) | 319 |
| Chloride (Cl) | 27750 |
| Iron | 79 |
| pH - 4.98 | |
| Density - 1.05–1.06 | |

While an aqueous solution of sodium hydroxide is a particularly suitable alkalyzing agent, any inorganic base selected from the group consisting of the alkali metal, alkaline earth metal and ammonium hydroxides can be employed.

Advantageously, the blended crude of reduced water content is heated at the outset, and a temperature of at least 38° C. (100.4° F.) is maintained throughout introduction of all of the additives employed. It is also advantageous to preheat the produced water, or the solution of coagulating agent in produced water, before introduction into the blend, so that the produced water is at at least the temperature of the blend and, advantageously, at 55°–80° C. (131°–176° F.). The blend should be agitated continuously, to assure uniform distribution of the additives and increase contact at the interfaces between the disperse and continuous phases of the emulsion, but agitation of the types causing high energy shearing should be avoided.

Figure 2:
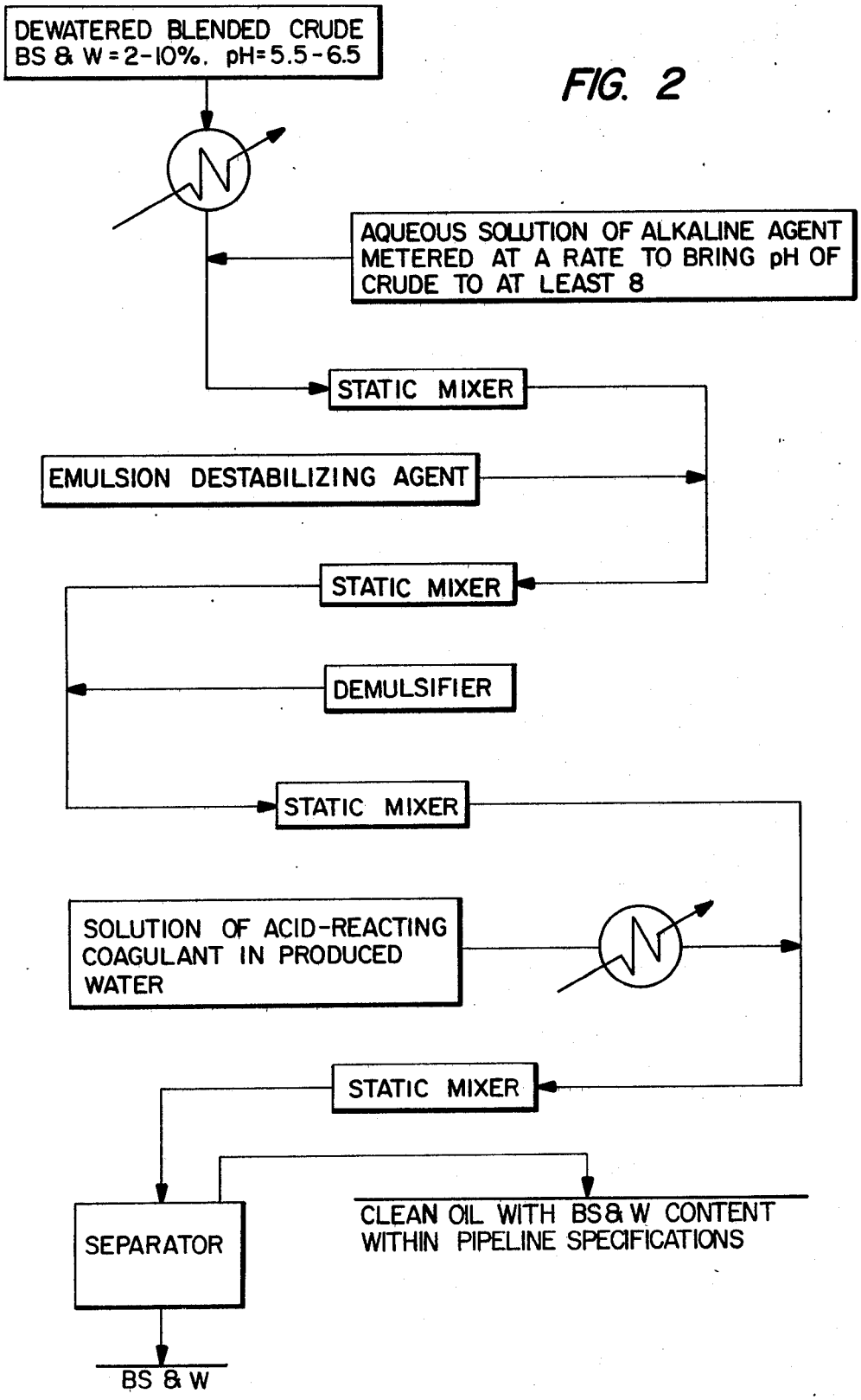
FIG. 2 is a flowsheet illustrating one continuous embodiment of the method.

With some crudes, and using some embodiments of the method, it is possible simply to combine the blended crude of reduced water content, an alkalyzing agent, an additive for at least destabilizing the emulsion of the crude, the produced water and the coagulating agent in a single heated vessel equipped for continual agitation of the liquid, so that the method is carried out without secial regard to the order of introduction of the components of the system. However, best results are usually achieved when the produced water and the coagulating agent are introduced after the additive for destabilizing the emulsion of the crude has been thoroughly and uniformly distributed throughout the blended crude. Best results are also obtained when the coagulating agent is dissolved in the produced water being recycled to the system, since that assures that the coagulating agent will be present in each increment of the blend which contains produced water. cl Carrying out the Method Continuously In many field installations, it is advantageous to carry out the method continuously, one advantageous continuous system being illustrated diagrammatically in FIG. 2. In such installations, crude obtained from a plurality of wells, or even from a plurality of fields, is provided at a gathering point, blended with condensate and dewatered by gravitational separation to provide, in suitable tankage, a supply of blended crude of reduced water content at an API gravity of at least 17 and advantageously at least 20, a BS&W content typically of 2–10% by volume and a pH typically at 5.5–6.5. In other tankage, a supply of the free water produced from one or more of the crudes is established. Viewing the installation as of semi-works scale, the blended crude of reduced water content is flowed continuously from the supply at, e.g., 30 cu. meters per day and is passed through a conventional heating zone where the temperature of the blended crude is raised to 60°-68° C. (140°-154° F.). From the heating zone forwardly to a point just prior to phase separation, all equipment through which the blend passes is thermally insulated. Total flow from the heating zone is passed continuously through a first static mixer, and at a point just upstream of the first mixer, an aqueous solution of sodium hydroxide (typically a 10 molar solution at the rate of 4 liters per cu. meter of the dewatered blended crude) is introduced continuously to bring the pH of the blended crude to 11-12. The blend is then flowed continuously through a second static mixer, and at a point between the first and second mixers, a solution of the emulsion destabilizer is continuously introduced. Typically, a 60% solution of ammonium bisulfate can be introduced at the rate of 1.2 liters per cubic meter of the dewatered blended crude. Total flow is then through a third static mixer, and at a point just upstream of that mixer, a solution of the coagulating agent in produced water, having been preheated to 60°-80° C. (140°-176° F.), is introduced continuously. Typically, the coagulating agent can be filter alum dissolved in the produced water to provide a 0.8-1% by weight solution, with the preheated solution being introduced at the rate of 20-30 liters per cubic meter of the dewatered blended crude. Total flow is then through a fourth static mixer and a demulsifier is introduced, typically as a 50% solution of the demulsifier in xylene at the rate of 0.7 liters per cubic meter of the dewatered blended crude. The entire flow is delivered from the fourth mixer to a phase separation device, typically a conventional heater-treater, for separation of the liquid into at least a clean oil phase and a water phase, with the separated solid particulates passing with the water phase and the oil phase being recovered as clean oil at a BS&W content within pipeline specifications.

Static mixers are advantageously of the fixed in-line helical deflector type marketed by Kenics Corp., North Andover, Mass., USA, under the trademark KENICS, so that uniform mixing is achieved without high energy shearing action and emulsification as a result of the agitation is therefore avoided.

Relative Proportions

The amount of alkalyzing agent employed should be in the range of 0.2-1.5% of the weight of the blended crude, with the particular proportion within that range depending upon the pH of the blended crude, the amount of inorganic sulfur carried by the crude, the amount and nature of destabilizing agent employed, the pH and amount of the produced water used, and the particular alkalyzing agent chosen.

The amount of emulsion destabilizing agent employed depends upon the nature of the particular crude to be treated, smaller proportions often being adequate for, e.g., crudes which have already been conventionally treated in the field and crudes which are inherently easily treatable, while larger proportions are usually required when the crude has had no previous treatment and when the crude has a particularly high BS&W content or a particularly stable emulsion and is therefore particularly difficult to treat. When, as is advantageous for crudes resulting from enhanced oil recovery procedures, and particularly for crudes resulting from fireflooding or other thermal methods, ammonium bisulfite is employed as the additive for destabilizing the emulsion, the amount required is in the range of 0.03-0.5% of the weight of the blended crude. When, as an alternative to ammonium NaHS $9H_2O$ is used, the amount should be 0.2-1% of the weight of the blended crude, and when sodium hydrosulfite is employed, the amount should be 1.9-3.8% of the weight of the blended crude.

Produced water should be employed in an amount at least equal to 3% of the volume of the dewatered blended crude, the upper limit depending upon economics. When the crude to be treated is one from which a large flocculated phase results when the emulsion of the crude has been broken and phase separation is attempted, the proportion of produced water should be increased accordingly.

Since, in any embodiment of the method, the action of the coagulating agent is affected by the pH of the liquid, the nature of the inorganic solids in the crude and the extent to which the solids are separated, the amount of produced water employed and the inorganic chemical content of the produced water, the small proportion of coagulating agent employed varies from case to case. In general, an amount of coagulating agent equal to at least 0.1 g. per liter of dewatered blended crude will be required. Under usual circumstances, the amount of coagulating agent required will not exceed 5 g. per liter of dewatered blended crude.

Demulsifiers useful in accordance with the invention are liquid compositions which include as active agents at least one polar compound which is a surfactant capable of dissolving or at least dispersing in the oil phase of the crude. Of the demulsifiers currently available in the trade, few have a beneficial effect when used conventionally to treat the heavy oil crudes obtained by thermal recovery procedures. One beneficial demulsifier is currently marketed by Champion Chemical Co., Edmonton, Alberta, Canada, under the designation CHAMPION BX6079. That demulsifier is a proprietary composition believed to comprise a combination of aliphatic and aromatic glycols in xylene as a diluent. Usually employed as a diluted composition comprising 40-50% by weight active material, balance diluent, such emulsifier when employed according to the invention are used in small proportions amounting to at least 0.01 ml per liter of total liquid, i.e., the total volume of dewatered blended crude, alkalyzing agent, emulsion destabilizer and produced water. Increasing the amount of the demulsifier above 0.1 ml per liter is not usually beneficial.

The following examples are illustrative.

EXAMPLE 1

One hundred parts by volume of a Husky Aberfeldy fireflood crude was employed which had been blended with 45 parts of condensate and dewatered to provide a dewatered blended crude having an initial pH of 6.2, and API gravity of approximately 18 and a BS&W content of approximately 11% by volume. 1000 ml of the dewatered blended crude was adjusted to a pH of approximately 11 by addition of 4 ml of 10 molar aqueous sodium hydroxide solution. 12 ml of produced water having a pH of 4.9, 2 g. of filter alum, 8 ml of 60% by weight aqueous solution of ammonium bisulfite, 74 ml of the blended crude at its adjusted pH and 6 ml of 10 molar sodium hydroxide solution were combined in that order in a 100 ml tapered oil centrifuge tube and shaken vigorously. The contents of the centrifuge tube were heated for 30 minutes on a water bath at 60° C. (140° F.) and then centrifuged for 20 minutes in a Model EXD International Centrifuge at 1250 r.p.m., the tube then exhibiting an upper clean oil phase (71%), an intermediate flocculated phase (2%), a water phase (12%) and a particulate solids phase (15%), the latter appearing mainly as white particles. The BS&W content of the oil phase was determined according to ANSI/ASTM D 96-73 and found to be 0.4% by volume. When the same procedure was carried out with a sample prepared by mixing 110 ml of the pH-adjusted blended crude with 9 ml of 60% by weight ammonium bisulfite aqueous solution and blending 75% by volume of that mixture with 25% by volume produced water, omitting alum and sodium hydroxide (other than that originally employed to adjust the pH of the blended crude), the BS&W content was 4% by volume.

EXAMPLE 2

A Mobil/GC Kitscoty fireflood crude was blended with condensate and dewatered to provide a blended crude having a pH of approximately 11, an API gravity of 17.7 and a BS&W content of 4.0% by volume. Using the same procedure and equipment as in Example 1, 10% by volume of produced water having a pH of 4.9, 5% of a 60% by weight aqueous solution of ammonium bisulfite, 1.0 g. of filter alum, 80% of the blended and pH-adjusted crude, and 5% of a 10 molar aqueous sodium hydroxide solution were combined in the centrifuge tube, shaken, heated and centrifuged, providing a clean oil phase of 77%, an intermediate flocculated phase of 1%, a water phase of 21% and a solids phase of 1%. The BS&W content of the oil phase was 0.2% by volume and the phase separation yield 99.9%. Repeating the procedure, but with the raw Kitscoty crude at an API gravity of 12.7, without addition of condensate, the clean oil phase of the centrifuged material was 80%, the water phase 19% and the solids phase 1%, the BS&W content of the clean oil phase being 0.8% by volume and the phase separation yield 96.7%.

EXAMPLE 3

While the procedure of Examples 1 and 2 serves well in the laboratory for demonstration purposes, it gives little chance to obtain and maintain a uniform mixture nor does it provide the benefits, including maintenance of a relatively high pH, achieved by sequential addition of the treating agents. Thus, in the laboratory, better and more uniform results are achieved with the method using a 1000 ml 3-neck flask equipped with a heating mantle, a motor-driven propeller agitator and a thermometer, and carrying out in the flask all steps of the method between blending of the crude with diluent, dewatering and centrifuging. Employing that equipment, 200 ml of the blended crude of Example 1 is placed in the flask and the agitator started at high speed, 5.0 ml of the 10 molar sodium hydroxide solution is than added and high speed agitation continued for 5 minutes. With the agitator then reduced to low speed, 12.5 ml of an aqueous 60% solution of ammonium bisulfite is added. 1.25 g. of filter alum is dissolved in 12.5 ml of water and heated to 60° C. (140° F.) and added to the flask while slow speed agitation continues, and 7.5 ml of 10 molar aqueous sodium hydroxide solution is then added. With slow speed agitation continuing, the heating mantle is energized and the mixture heated at 60° C. (140° F.) for 30 minutes, after which the material is transferred to the centrifuge tubes for centrifuging and determination of the BS&W content of the oil phase. As an alternative, the heating mantle can be energized to commence heating when the blended crude has been placed in the flask.

EXAMPLE 4

To demonstrate that, for some crudes, the method is enhanced if a chemical demulsifier is present at the time the coagulent and produced water act in the presence of the destabilized water-in-oil emulsion of the crude, a difficultly treatable Husky Aberfeldy fireflood crude was blended with condensate and dewatered to provide a dewatered blended crude having a BS&W content of 32% by volume, the blended crude was alkalyzed with 10 molar sodium hydroxide solution to raise the pH to approximately 11, and the procedure of Example 1 was repeated, with the formulation consisting of 10% by volume of produced water having a pH of 4.9, 5% of a 60% ammonium bisulfite aqueous solution, 1.0 g. filter alum, 80% of the pH-adjusted blended crude, 5% of 10 molar aqueous sodium hydroxide solution, and 0.02 ml of a conventional demulsifier (CHAMPION BX6079, provided by Champion Chemical Co., Edmonton, Alberta, Canada), the demulsifier being used at a concentration such that the rate of addition was equal to 4 qts. per 100 bbl. of oil. After shaking and then heating for 30 mins. at 60° C. (140° F.), the mixture was centrifuged for 20 mins. at 1250 r.p.m. and the BS&W of the oil phase was found to be nil. The oil phase amounted to 54%, the intermediate flocculated phase to 9%, the water phase to 34% and the solids phase to 3%, with a phase separation yield of 99.3%. For comparison, the same crude was pre-treated with the same conventional demulsifier at the same addition rate, heated at 60° C. (140° F.) for 30 mins. and centrifuged for 20 mins. at 1250 r.p.m., yielding an oil phase with a BS&W content of 3.4, and the oil phase so obtained was then treated again as first described in this example, using the same proportions of ammonium bisulfite, produced water, filter alum, oil and sodium hydroxide solution (but omitting the demulsifier) and the same conditions of heating and centrifuging. The BS&W content of the oil phase was found to be 1.6% by volume.

EXAMPLE 5

A Murphy Silverdale fireflood crude was blended with condensate and dewatered to provide a blended crude having an API gravity of 17.9 and a BS&W content of 43.0%, and the pH of the blended crude was adjusted to approximately 11 by addition of sodium hydroxide. The procedure of Example 1 was then repeated, with the formulation consisting of 10% by volume produced water with a pH of 4.9, 5% of ammonium bisulfite 60% aqueous solution, 1 g. of filter alum, 80% of the blended and pH-adjusted Silverdale crude, 5% 10 molar sodium hydroxide solution, and 0.03 ml of the same demulsifier employed in Example 4, that addition being at the rate of 6 qts. per 100 bbl. of oil. After heating and centrifuging, the oil phase was 45%, the water phase 52% and the solids phase 3%, with a phase separation yield of 98.5%. The BS&W content of the oil phase was 0.2% by volume.

EXAMPLE 6

A Husky Aberfeldy fireflood crude which had had no previous treatment was blended with condensate and dewatered to provide a blended crude having an API gravity of 21.3, a pH of 6.4 and a BS&W content of 18.0% by volume. Using the equipment and general procedure described in Example 3, 200 ml of the blended crude was placed in the 3-neck flask, agitation commenced at high speed and the mantle energized to heat the crude to 38° C. (100.4° F.), 1.5 ml of 10 molar aqueous sodium hydroxide was then added. With high speed agitation continuing and the same temperature maintained, there were then added in sequence 1.5 ml of the same demulsifier employed in Example 4, 2.0 ml of a 60% solution of ammonium bisulfite in water, a solution of 0.2 g. of filter alum in 10 ml of produced water preheated to 38° C., and then an additional 1.5 ml of 10 molar sodium hydroxide solution. Mixing was continued for approximately 10 mins., while heating at 38° C. continued. The material was then transferred to centrifuge tubes and heated in a water bath at 75° C. (167° F.) and then centrifuged at 1250 r.p.m. for 20 mins. The oil phase amounted to 58% and there was a 3% intermediate flocculated phase, a 7% water phase below the flocculated phase, a 3% solids phase and a 1% water phase below the solids phase. The BS&W content of the oil phase was 0.4%.

Though the demulsifier available as CHAMPION BX6079 was employed in Examples 4–6, at least equivalent results can be obtained by repeating those examples with the demulsifier disclosed in copending application Ser. No. (397,696).

EXAMPLE 7

A field installation was set up to treat fireflood crude from a plurality of wells in the Husky Aberfeldy field, the crude to be treated being taken from the floating suction of the third of three successive settling tanks employed for that field and the free water separated in the first and second of the settling tanks being used as the source of produced water. Since the field installation could handle only a portion of the total crude from the field, the standard blended crude from the field was accepted for the feed to the field installation, so that the blended crude contained 25–30% condensate as the diluent and also contained a small amount of a conventional demulsifier used as a conventional treating agent in that field. The blended crude thus obtained had a BS&W content in the range of 2–10% by volume, an API gravity in the range of 20–24 and a pH in the range of 6–6.5. The pH of the produced water was in the range of 4.5–5.5. In the field installation, the blended crude was pumped continuously at a rate of approximately 30 cubic meters per day through a succession of three static mixers in series. To raise the pH to 11–12, a 30% sodium hydroxide aqueous solution was metered continuously into the flowing blended crude at a rate of 4 liters per cubic meter of crude at a point upstream of the first static mixer. At successive points between the first and second static mixers, the same demulsifier employed in Example 4, a 60% ammonium bisulfite aqueous solution, and a 1–3% solution of filter alum in the produced water were introduced continuously, the demulsifier having been diluted 50:50 with xylene and being metered into the flowing crude at the rate of 0.7 liters per cubic meter of oil, the ammonium bisulfite solution being metered in at the rate of 1.2 liters per cubic meter of oil, and the solution of filter alum in produced water being metered in at the rate of 20–30 liters per cubic meter of oil. From the last static mixer, the treated oil was flowed continuously to a conventional vertical heater-treater operated to heat the oil to 50°–70° C. (122°–158° F.) in the lower two-thirds of the tank. From the heater-treater, the resulting oil phase was flowed into a sales oil tank from which the oil was withdrawn periodically, via a floating suction line, to trucks. An average residence time in the heater-treater was approximately 72 hrs. The BS&W of the oil delivered from the floating suction line of the sales tank was maintained below 0.5% by volume.

What is claimed is:

1. In the reduction to pipeline specifications of the BS&W content of petroleum crude which comprises a water-in-oil emulsion, has been blended with a compatible hydrocarbon diluent to provide an API gravity of at least 17 and from which free water has been separated as produced water, the method comprising
   - treating the dewatered blended crude to destabilize the water-in-oil emulsion;
   - providing in uniform distribution throughout the dewatered blended crude
     - an amount of produced water equal to at least 1% of the volume of the dewatered blended crude, and
     - a small proportion of at least one acid-reacting coagulating agent,
     - while maintaining the pH of the dewatered blended crude at at least 8;
   - maintaining the resulting treated crude at 52°–88° C. (125°–190° F.) for at least a few minutes;
   - then separating the treated crude into at least an oil phase and a water phase; and
   - recovering the oil phase as a clean blended crude oil having a BS&W content within pipeline specifications and in a yield significantly in excess of that which can be recovered without use of produced water and coagulating agent.

2. The method according to claim 1, wherein
   - the step of treating the dewatered blended crude to destabilize the emulsion is accomplished by
     - adding an alkalyzing agent to the dewatered blended crude in an amount adequate to bring the pH of the dewatered crude to at least 8, and
     - adding to the dewatered blended crude an emulsion destabilizing agent which is acidic; and
   - the method further comprises
     - adding to the treated crude at a time not substantially earlier than the addition of the coagulating agent an additional quantity of an alkalyzing agent adequate to reestablish a pH of at least 8 when the coagulating agent is present in the treated crude.

3. The method according to claim 2, wherein
   - the treated crude is agitated and maintained at 52°–88° C. (125°–190° F.) between addition of the emulsion destabilizing agent and addition of the coagulating agent.

4. The method according to claim 3, wherein
   - the treated crude is also agitated and maintained at 52°–88° C. (125°–190° F.) subsequent to addition of the coagulating agent.

5. The method according to claim 2, wherein
   - the emulsion destabilizing agent is ammonium bisulfite and the coagulating agent is filter alum.

6. The method according to claim 1, wherein
   - the blended crude is maintained at a pH of at least 10 when the coagulating agent is present.

7. The method according to claim 1, wherein
   - the blended crude has an API gravity of at least 20.

8. The method according to claim 1, wherein
   - the step of separating the treated crude is carried out by gravitational separation.

9. The method according to claim 1, wherein
the crude is a heavy oil crude obtained by a thermal production procedure;
the step of treating the dewatered blended crude to destabilize the water-in-oil emulsion of the crude is carried out by uniformly distributing through the crude a small proportion of ammonium bisulfite while the blended crude is at a pH of at least 10; and
the coagulating agent is filter alum.

10. The method according to claim 1, wherein
the coagulating agent is dissolved in at least a portion of the produced water before addition of the produced water to the crude.

11. The method according to claim 10, wherein
the blended crude is heated to a temperature above ambient before addition of the solution of coagulating agent in produced water; and
the solution of coagulating agent in produced water is preheated to at least the temperature of the blended crude.

12. The method according to claim 10, wherein
the coagulating agent is dissolved in the total amount of produced water employed.

13. The method according to claim 1, further comprising
providing in uniform distribution throughout the blended crude at the time of addition of the produced water and coagulating agent a small proportion of at least one demulsifier which comprises a surfactant which is at least dispersible in the oil of the crude and which, when used conventionally to treat the same blended crude, is incapable of providing a BS&W content within pipeline specifications.

14. The method according to claim 1, wherein
the dewatered blended crude is flowed continuously through a first static mixer;
an aqueous solution of an inorganic alkalyzing agent is metered into the dewatered blended crude upstream of the first static mixer at a rate adequate to raise the pH of the dewatered blended crude to at least 8;
the pH-adjusted blended crude is flowed continuously to a final static mixer;
a liquid solution of an emulsion destabilizing agent, the produced water and the coagulating agent are metered continuously into the pH-adjusted crude between the first static mixer and the final static mixer; and
the treated crude is flowed continuously from the final static mixer to a separation zone.

15. The method according to claim 14, wherein
the pH-adjusted blended crude is flowed continuously from the first static mixer to a second static mixer and the emulsion destabilizing agent is metered into the blended crude between the first and second static mixers;
the treated blended crude is flowed continuously from the second static mixer;
the coagulating agent is dissolved in the produced water; and
the resulting solution of coagulating agent in produced water is continuously metered into the treated blended crude in a location between the second static mixer and the final static mixer.

* * * * *